US005494518A

United States Patent [19]

Keane et al.

[11] Patent Number: 5,494,518

[45] Date of Patent: Feb. 27, 1996

[54] SLOT COATING DIE HEAD SUPPORT STRUCTURE

[75] Inventors: John J. Keane, Alpharetta; Richard E. Leeds, Snellville; Charles H. Scholl, Duluth, all of Ga.

[73] Assignee: Nordson Corporation, Westlake, Ohio

[21] Appl. No.: 251,526

[22] Filed: May 31, 1994

[51] Int. Cl.[6] ..... B05C 3/02

[52] U.S. Cl. ..... 118/410; 118/413; 118/424; 118/425; 118/427; 118/428; 118/500

[58] Field of Search ..... 118/410, 413, 118/419, 421, 423, 424, 425, 427, 428, 500

[56] References Cited

U.S. PATENT DOCUMENTS

| | | | |
|---|---|---|---|
| 4,512,279 | 4/1985 | Damrau et al. | 118/411 |
| 4,611,476 | 9/1986 | Fleissner | 68/158 |
| 4,889,072 | 12/1989 | Krimsky | 118/244 |
| 5,112,653 | 12/1992 | Damrau et al. | 427/356 |
| 5,167,712 | 12/1992 | Shibata et al. | 118/410 |
| 5,186,753 | 2/1993 | Nakazawa et al. | 118/410 |
| 5,376,177 | 12/1994 | Elvidge et al. | 118/410 |

*Primary Examiner*—Robert J. Warden
*Assistant Examiner*—Christopher Y. Kim
*Attorney, Agent, or Firm*—Calfee Halter & Griswold

[57] ABSTRACT

A support structure for a slot coating die is provided. The support structure comprises a plurality of support members connected with a frame, and a slot coating die head structure which rests on and is coupled to certain of the support members. The frame comprises a pair of spaced apart side frame members, and the plurality of support members comprises: (i) a pair of outer support members, each disposed adjacent a respective side frame member and pivotally supported thereon, (ii) a pair of intermediate support members, each disposed adjacent a respective outer support member and pivotally supported thereon, and (iii) a pair of inner support members, each disposed adjacent a respective intermediate support member and pivotally supported thereon. Each of the pair of inner support members has a respective support surface, and the slot coating die structure rests on the support surfaces of the pair of inner support members and is coupled to the pair of inner support members for movement therewith.

16 Claims, 6 Drawing Sheets

SLOT COATING DIE HEAD SUPPORT STRUCTURE

TECHNICAL FIELD

The present invention relates to a support structure for a slot coating die head.

BACKGROUND

Slot coating dies are well known for applying hot or cold melt materials (e.g., hot melt adhesives, varnishes, etc.) to substrates such as webs of printed material. A slot coating die typically comprises a slot coating die head through which the hot or cold melt material is extruded onto the substrate, as the substrate is moved past the slot coating die head.

To support the slot coating die head, support bracketry is provided. The support bracketry must allow for gross adjustment of the slot coating die relative to the substrate, to enable system set up and to allow for cleaning of the slot coating die head. Additionally, to properly apply a coating to a moving substrate, it is important to (i) provide for fine adjustment of the distance between the slot coating die head and the substrate, and (ii) provide for adjustment of the angular orientation of the slot coating die head relative to the substrate.

A prior slot coating die head structure that has been used by the assignee of the present invention is shown in FIG. 1. The prior art structure of FIG. 1 comprises a pair of outer support members "A" pivotally supported on a frame (not shown), a pair of intermediate support members "B" pivotally connected to the outer support members, and a pair of inner support members "C" pivotally connected to the intermediate support members. A die head is mounted on the front side of a support plate "D", and the support plate is connected to the backside of the pair of inner support members. The outer support members may be pivoted relative to the frame to provide for gross adjustment of the die head relative to the substrate. The intermediate support members may be pivoted relative to the outer support members, to provide for fine adjustment of the distance between the coating die head and the substrate. The inner support members may be pivoted relative to the intermediate support members, to provide for adjustment of the angular orientation of the coating die head relative to the substrate.

With the foregoing type of arrangement as shown in FIG. 1, the slot coating die is effectively supported from behind, and a number of adjustment devices "E" must be manipulated to (i) make fine adjustments of the distance between the slot coating die head and the substrate, or (ii) adjust the angular orientation of the coating die head relative to the substrate. Specifically, adjustments must be made by a "push-pull" type of action, i.e., one portion of a support member must be pulled and another portion of the support member must be pushed in order to pivot the support member to an adjusted position. Such type of action requires a number of adjustment devices "E" and requires both the push and pull types of actions to adjust a portion of the slot coating die head relative to the substrate. Adjustment of the bracketry components also sometimes necessarily includes flexing of the components.

SUMMARY OF THE PRESENT INVENTION

The present invention provides a new and useful support structure for a slot coating die head. In particular, the present invention provides support structure which supports the slot coating die head in such a manner that the adjustment process is simplified considerably. Moreover, with the support structure of the present invention, there is also a more favorable stress distribution on the various components which support the slot coating die head.

According to the present invention, a plurality of support members are connected to a frame. A slot coating die head is supported so that it effectively rests on portions of certain of the support members and is coupled to those support members. In essence, the slot coating die head is supported from below by those support members. By supporting the slot coating die head in this manner, adjustments of the slot coating die head relative to the substrate are simplified considerably.

According to the preferred embodiment, the support members include (i) a pair of outer support members, each of which is pivotally connected to the frame, (ii) a pair of intermediate support members, each of which is disposed adjacent a respective outer support member and pivotally connected to the outer support member, and (iii) a pair of inner support members, each of which is disposed adjacent a respective intermediate support member and pivotally connected to the intermediate support member. The intermediate support members may be pivoted relative to the outer support members to provide fine adjustment of the distance between the slot coating die head and a substrate. The inner support members may be pivoted relative to the intermediate support members, to provide for angular adjustment of the slot coating die head relative to the substrate. The inner support members have support surfaces upon which the slot coating die head rests to effectively support the die coating head from below. Moreover, the slot coating die head is coupled to the inner support members in such a manner that the slot coating die head can be simply and efficiently adjusted relative to the substrate.

Specifically, the slot coating die head is connected to a support bar which extends between the inner support members. The end portions of the support bar rest on respective surfaces of the inner support members. A pair of fasteners extend through respective openings in the support bar and fasten the support bar to the inner support members. At least one of the openings comprises a slot which is elongated in the direction of the support bar, to allow some relative movement of the fasteners along the length of the support bar. Spring washers disposed between the heads of the fasteners and the support bar keep a constant bias between the fasteners and the support bar, while allowing some movement of the fasteners relative to the support bar, as the position of the die head relative to the substrate is being adjusted. This manner of coupling the slot coating die head with the inner support members enables the slot coating die head to be simply and efficiently adjusted relative to the substrate.

An additional aspect of the present invention is a relatively simple structure for adjusting the intermediate support members relative to the outer support members. An adjustment shaft effectively acts between the inner and outer support members, to adjust the relative positions of those members. A biasing structure applies a biasing force between the inner and outer support members, thus negating play in structure due to manufacturing tolerances and backlash in the adjustment shaft.

Still further, a slot in each inner support member is adapted to receive a pin such as a threaded rod fixed to the adjacent intermediate support member, to allow angular adjustment of the inner support member relative to the adjacent intermediate support member. A clamping nut threads onto the rod to secure or release the adjusted angular position of inner support member relative to the adjacent intermediate support member. Angular adjustment of the inner support member effects adjustment of the angular orientation of the slot coating die head relative to the substrate.

With the support bracketry of the present invention, gross adjustment of the entire bracket assembly is provided by adjusting the outer support members between two extreme positions. One extreme position spaces the slot coating die head a substantial distance from the substrate, for initial set up and for cleaning of the slot coating die head. The other extreme position is an operating position, in which the slot coating die head is positioned to extrude a layer of hot or cold melt material onto the substrate. A double acting air cylinder acts on the outer support members to effect such an adjustment.

The intermediate support members may be pivoted relative to the outer support members, to adjust the spacing between the slot coating die head and the substrate. The intermediate support members are adjusted relative to the outer support members by moving the adjustment shaft to an adjusted position, to adjust the relative positions of those support members.

Finally, each inner support member may be adjusted relative to an adjacent intermediate support member by (i) loosening a clamping nut which maintains those members in a predetermined angular relation to each other, (ii) pivoting the inner member to an adjusted angular position, and (iii) tightening the nut to maintain the intermediate and inner support members in an adjusted angular position.

Further features and objects of the present invention will become apparent from the following detailed description and accompanying drawings.

DETAILED DESCRIPTION OF THE PREFERRED EMBODIMENT

Figure 1:
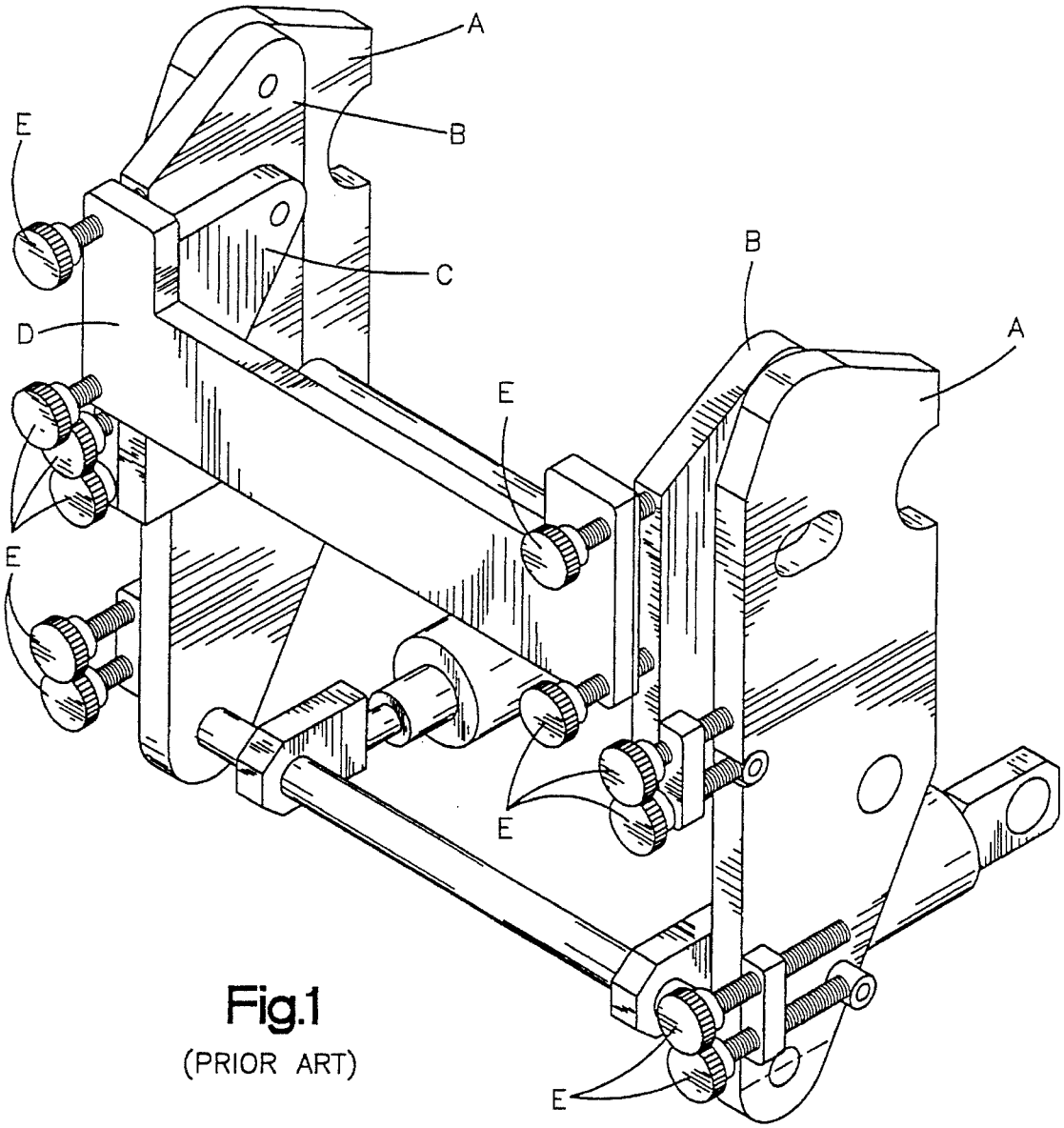
Fig.1 (PRIOR ART)
FIG. 1 is a schematic, perspective view of a prior art slot coating die head.
Figure 2:
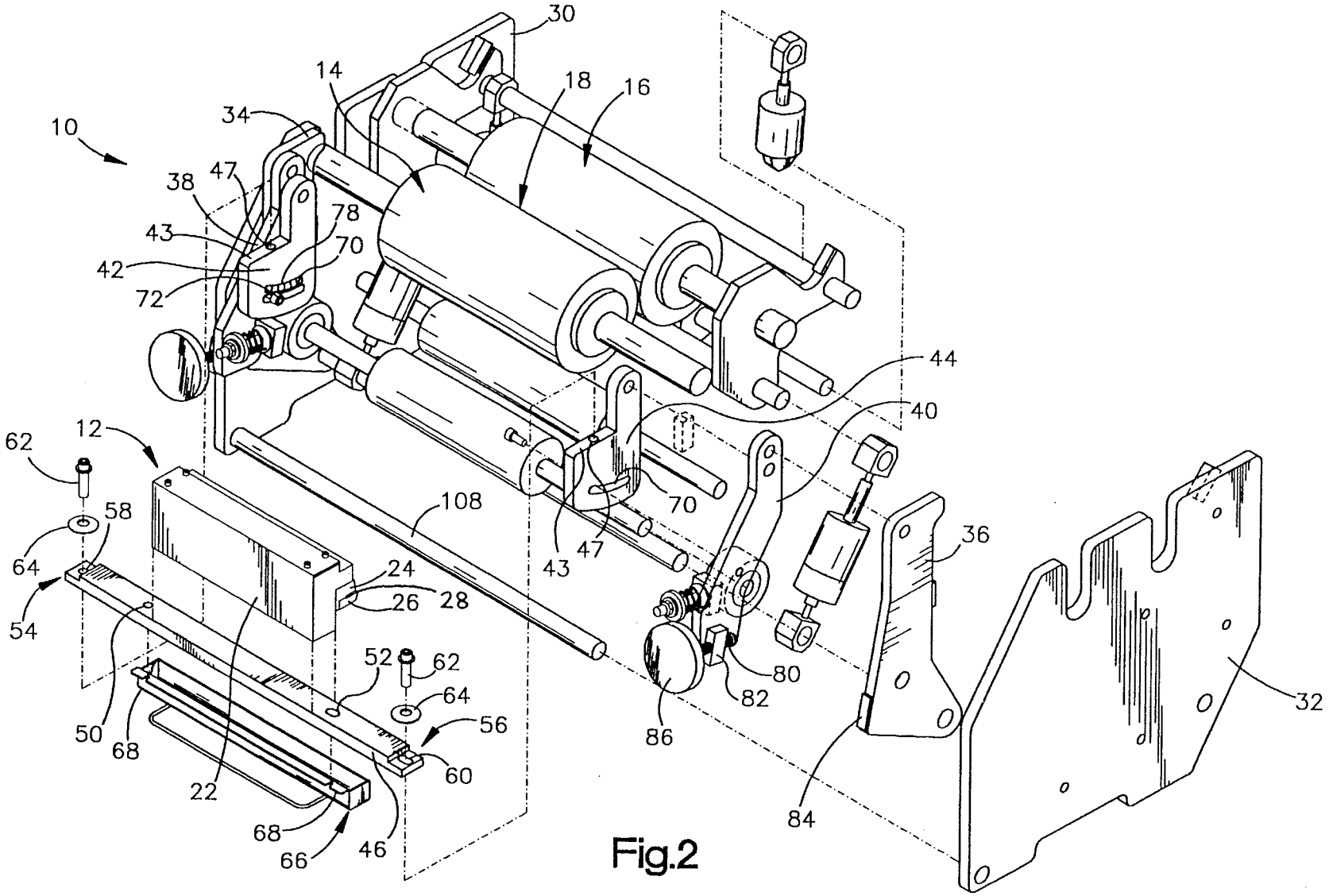
FIG. 2 is an exploded schematic, perspective view of the principal components of support bracketry for a slot coating die head according to the principles of the invention.
Figure 3:
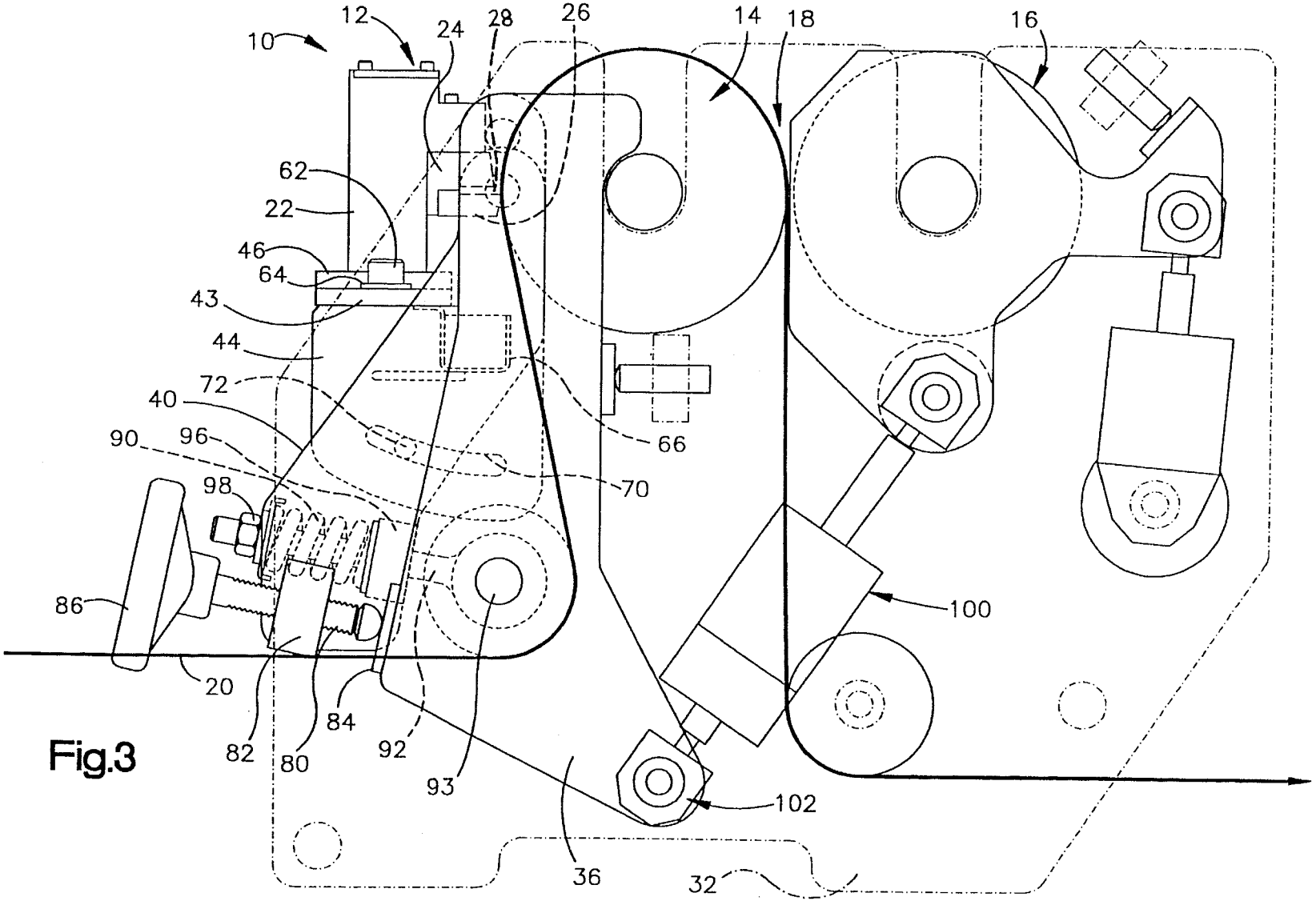
FIG. 3 is a right side view of the bracketry of FIG. 2 with some portions omitted.
Figure 4A:
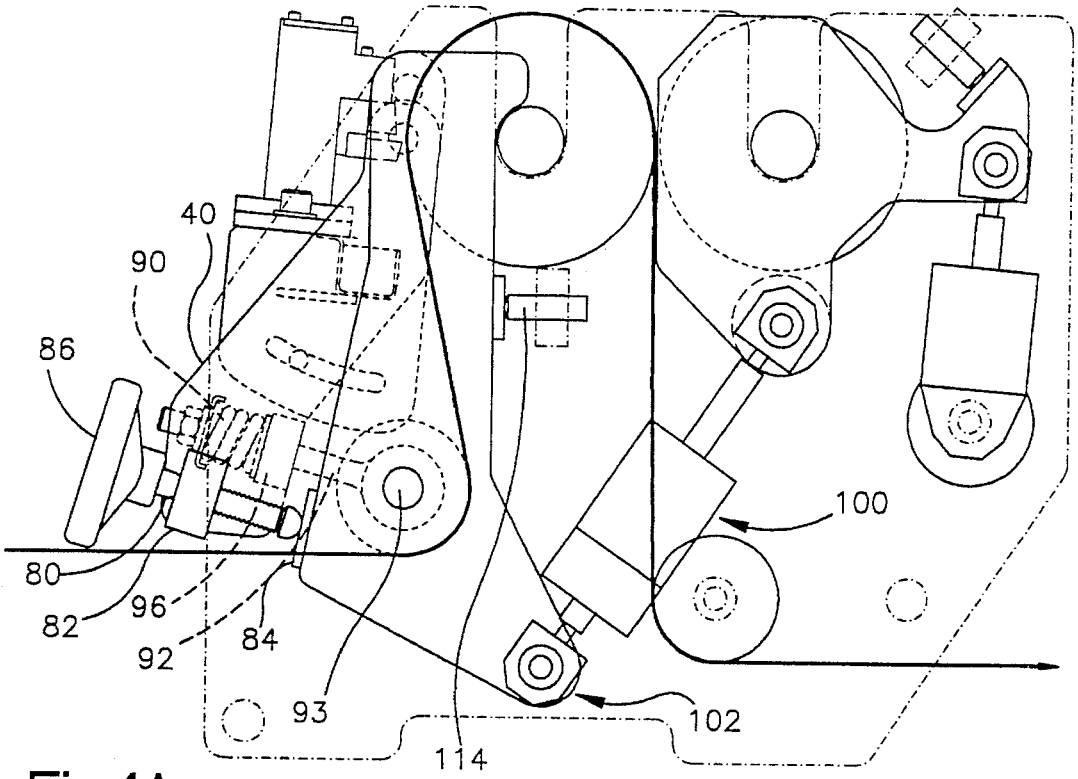
FIG. 4A is a side view similar to FIG. 3 with the intermediate support member in one position.
Figure 4B:
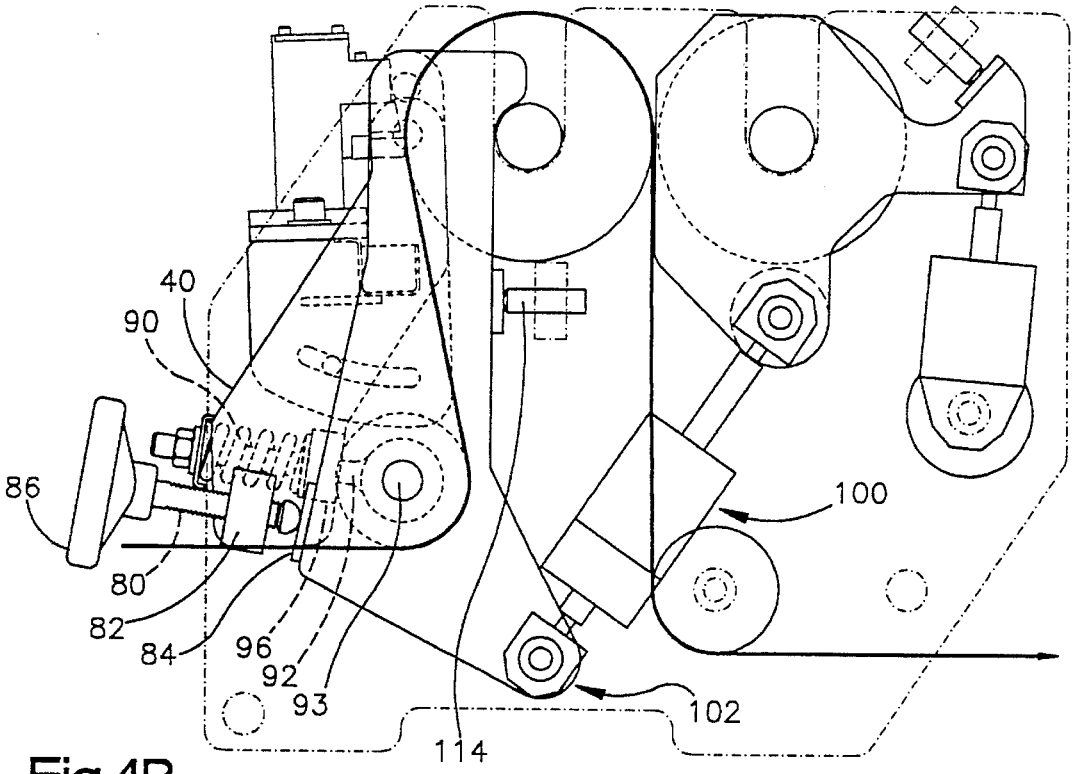
FIG. 4B is a side view similar to FIG. 3 with an intermediate support member in another adjusted position.
Figure 5A:
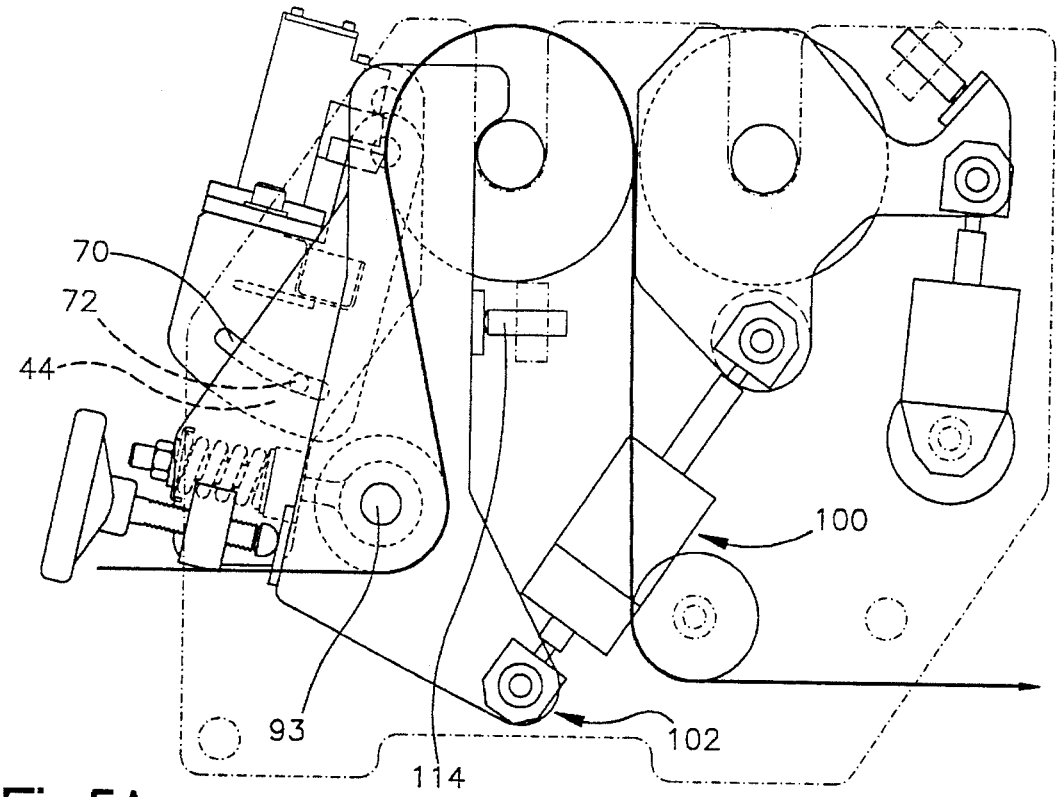
FIG. 5A is a side view similar to FIG. 3 with the inner support member in one of its adjusted positions.
Figure 5B:
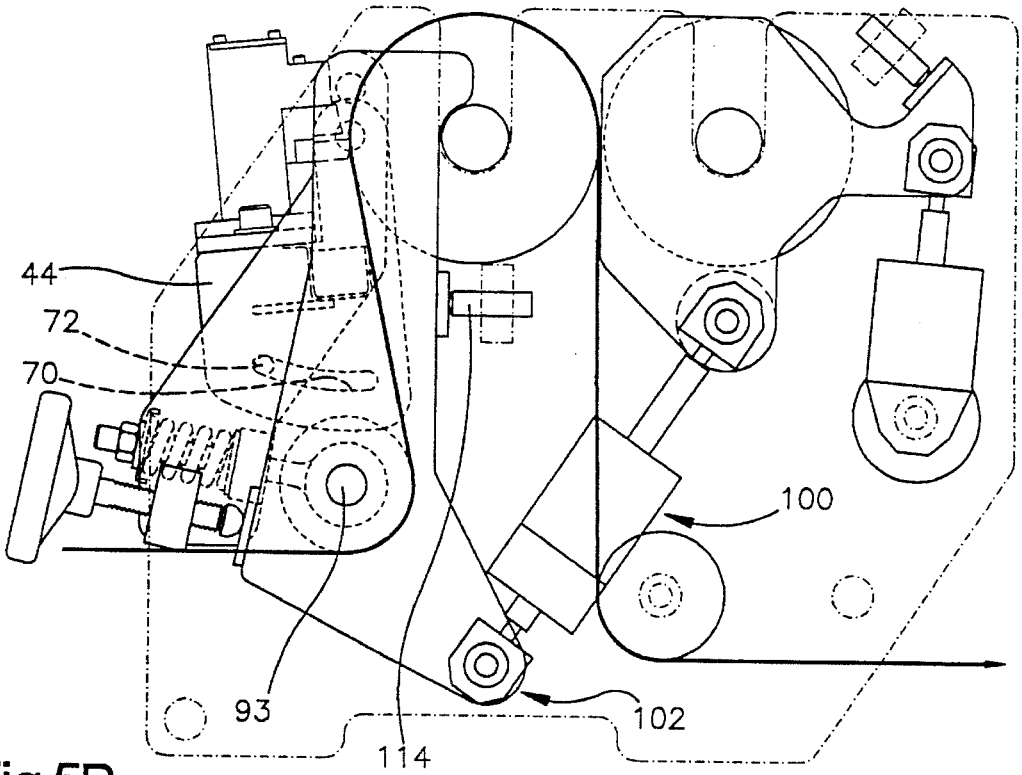
FIG. 5B is a side view similar to FIG. 3 with inner support member in another adjusted position.

As discussed above, the present invention relates to support structure for a slot coating die head. FIGS. 2 and 3 illustrate the basic components of a slot coating die assembly 10, including a slot coating die 12 and support structure for the slot coating die head, according to the present invention. The slot coating die assembly 10 includes a pair of rollers 14, 16 which form a nip 18 therebetween. A web 20 (FIG. 3) to which is to be applied a layer of hot or cold melt material is wrapped substantially around the roller 14 and is carried by the roller 14 past the slot coating die 12 and into the nip 18 formed between the rollers 14, 16.

The slot coating die 12 includes a base 22 and a pair of die members 24, 26. The die members 24, 26 form an exit slot 28 through which a hot or cold melt material is extruded onto the web 20. The hot or cold melt material may be an adhesive, varnish, or other type of melt material which would be typically extruded through a slot coating die.

In the slot coating apparatus of FIGS. 2 and 3, the rollers 14, 16 are supported on a pair of side frame members 30, 32. The support bracketry for the slot coating die head extends between and is connected to the side frame members 30, 32. Basically, the support bracketry includes (i) a pair of outer support members 34, 36, each of which is pivotally connected to a respective one of the side frame members 30, 32, (ii) a pair of intermediate support members 38, 40, each disposed adjacent a respective outer support member and pivotally connected to the outer support member, and (iii) a pair of inner support members 42, 44, each of which is disposed adjacent an intermediate support member and pivotally connected to the intermediate support member. The base 22 of the slot coating die head is coupled to a support bar 46 which, in turn, rests on and is connected to the inner support members 42, 44 in a manner described below.

As described above, the intermediate support members 38, 40 are pivotally connected to respective outer support members 34, 36, and the inner support members 42, 44 are pivotally connected to respective intermediate support members 38, 40. Thus, when the outer support members pivot relative to the side frame members 30, 32, they carry the intermediate and inner support members with them. When the intermediate support members 38, 40 pivot relative to the outer support members 34, 36, they carry the inner support members 42, 44 with them. This type of arrangement provides for a complex movement of the support members either with each other or relative to each other.

According to the present invention, the slot coating die 12 is effectively supported from below by the inner support members 42, 44. Specifically, the base 22 of the slot coating die 12 is coupled to the support bar 46. The support bar 46, in turn, rests on support surfaces 43 of the inner support members 42, 44, and is coupled to each of the inner support members 42, 44. Thus, the slot coating die 12 is effectively supported from below by the inner support members 42, 44. Such structure provides for relatively simplified adjustment of the slot coating die 12, as discussed below.

The support bar 46 has a pair of spaced apart openings 50, 52 for receiving mounting studs (not shown) which extend from the base 22 of the slot coating die head. The opening 52 is a slot which is elongated slightly in a direction lengthwise of the support bar 46. Such a mounting accommodates some thermal expansion of the components during operation of the slot coating die head.

At the ends of the support bar 46, there are a pair of reduced-thickness end portions 54, 56. The end portion 54 has a circular opening 58. The end portion 56 has a slot 60 which extends somewhat lengthwise of the length of the support bar 46. Mounting bolts 62 extend through each of the openings 58, 60 in the end portions 54, 56 of the support bar 46. Each mounting bolt 62 extends into a bore 47 formed in each of the inner support members 42, 44 to couple the end portions of the support bar 46 to the inner support members 38, 40. A spring washer 64 is disposed between the head of each mounting bolt 62 and the opening 58 in the support bar 46. Another spring washer 64 is disposed between the head of the other mounting bolt 62 and the slot 60 in the support bar 46. The spring washers 64 maintain tension between the support bar 46 and the inner support members 42, 44, while also allowing some pivotal movement of the support bar 46 relative to the inner support members 42, 44. Moreover, the slot 60 in the end portion 56 of the support bar 46 further accommodates some thermal expansion of the components due to heat of the coating operation.

A drip pan 66 has a pair of slots 68 formed in a flange at its upper end. Those slots 68 are aligned with drilled and tapped holes (not shown) on the underside of the support bar 46, to allow the drip pan 66 to be fastened to the support bar 46. As seen from FIGS. 3–6, the drip pan 66 is disposed gravitationally below the exit slot 28 of the slot coating die head. This provides for capture of material dripping from the slot coating die head irrespective of its adjusted position.

Each of the inner support members 42, 44 has an arcuate slot 70. A pin such as a threaded rod 72, fixed to the adjacent intermediate support member extends from the intermediate support member through the arcuate slot 70, and allows arcuate movement of the inner support member relative to the adjacent intermediate support member. A clamping nut (not shown) threads onto the rod 72 to secure or release the adjusted angular position of inner support member relative to the adjacent intermediate support member. Also, a calibrated scale 78 is provided along the arcuate slots 70, to assist an operator in adjusting the angular position of an inner support member relative to an adjacent intermediate support member.

The intermediate support members 38, 40 are adapted for adjustment relative to the outer support members. Specifically, an externally threaded shaft 80 extends through an internally threaded opening in a block 82 which is fixed to an intermediate support member. The inner end of the shaft 80 acts against a pad 84 on the backside of the adjacent outer support member. The outer end of the shaft 80 has a knob 86. Turning the knob 86 adjusts the position of the shaft 80 relative to the intermediate support member and the outer support member. This provides for fine adjustment of the position of the slot coating die head relative to the substrate.

A biasing force is effectively applied between the intermediate and outer support members. Specifically, a spring 90 surrounds a post 92 which extends away from a bearing for the pivot shaft 93 for the outer support members. The spring 90 acts between a block 96 disposed on the intermediate support member and a locking nut 98 coupled to the end of the post 92. That spring 90 effectively provides a biasing force between the intermediate and outer support members, while allowing some relative movement between them when the biasing force is overcome. In order to adjust the intermediate support member relative to the outer member, the associated knob 86 is turned in an appropriate direction, to adjust the position of shaft 80 and thereby effect the desired adjustment of the intermediate and outer support members. Once a desired adjustment has been made, the locking nut 98 is tightened, thereby locking the intermediate and outer support members in an adjusted position.

The outer support members 34, 36 are controlled for gross adjustment by a double acting air cylinder 100. One end of the air cylinder 100 is attached (via a clevis 102) to one of the outer support members. The air cylinder 100 is adapted to pivot the outer support members about the shaft 93 for gross adjustment of the support mechanism.

Figure 6A:
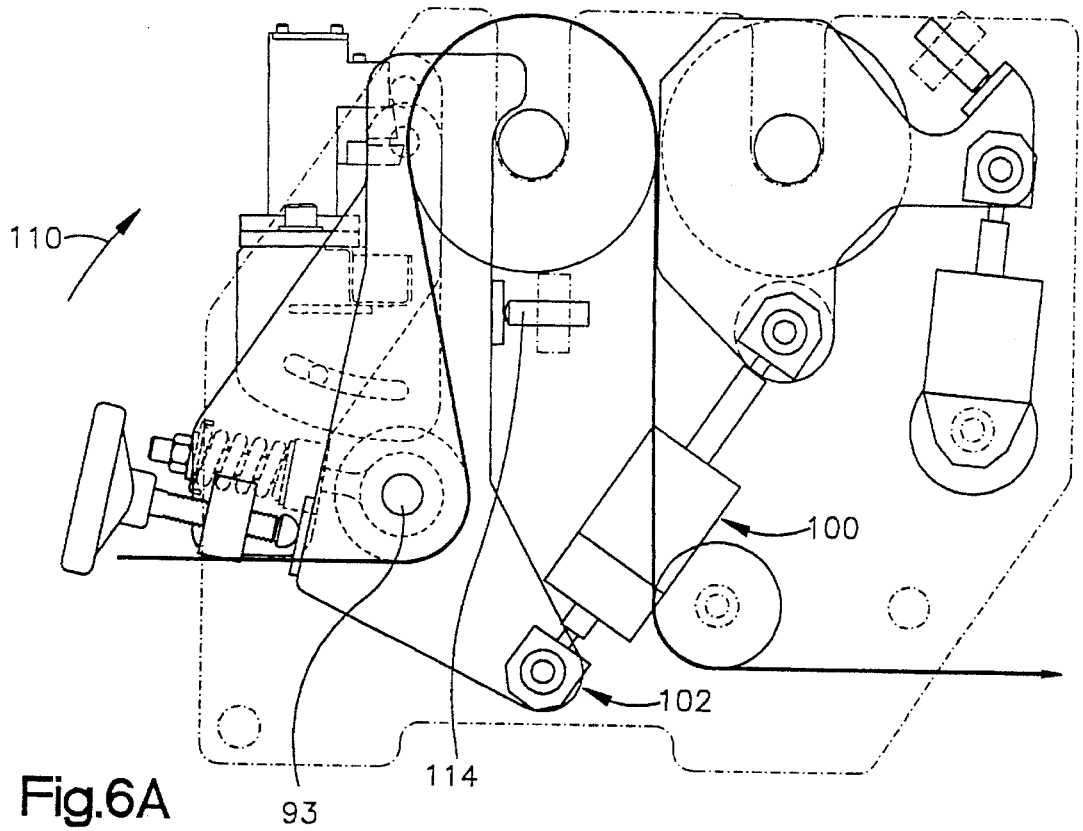
FIG. 6A is a side view similar to FIG. 3 with the outer support member in one adjusted position.
Figure 6B:
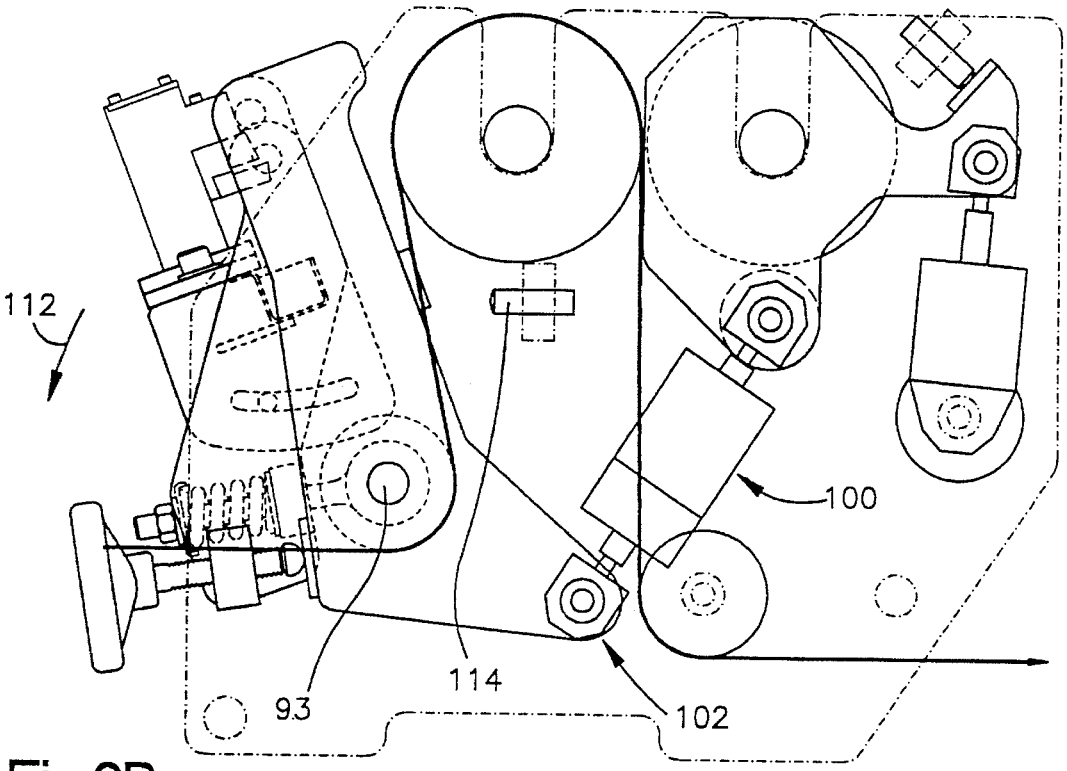
FIG. 6B is aside view similar to FIG. 3 with the outer support member in another adjusted position.

As seen from FIGS. 6A and 6B, the entire bracket assembly is adapted for gross adjustment by pivotal movement of the outer support members about the shaft 93. The double acting air cylinder 100 can move the outer support members in the directions of arrows 110, 112 between the position shown in FIG. 6A and the position shown in FIG. 6B. In the position of FIG. 6B, the slot coating die head is substantially spaced from the web, thereby to allow cleaning of the slot coating die head and initial set up of the unit. The outer support members may be pivoted to the position of FIG. 6A to place the slot coating die head in an operating position relative to the web. An adjustable stop member 114 limits overtravel of the outer members past the operating position and provides for gross adjustment of the die coating head.

Fine adjustment of the slot coating die head relative to the web is provided by the intermediate support members 38, 40. Those members can be adjusted between the positions shown in FIGS. 4A and 4B to provide for relatively fine adjustment of the coating head relative to the web. In order to make that adjustment, the knobs 86 are turned to move the intermediate support members 38, 40 to adjusted positions relative to the outer support members. Significantly, if it is found necessary to adjust the position of only one side of the slot coating die head, the intermediate member on one side of the assembly can be adjusted relative to its adjacent outer support member. The spring washers 64, and the elongated slot 60 in the support bar 46, will accommodate some movement of one side of the slot coating die head to allow such adjustment.

Still further, adjustment of the angular orientation of the slot coating die head relative to the web is effected by pivoting one or both of the inner support members 42, 44 relative to its (or their) respective intermediate support member(s). That requires (i) loosening the clamping nuts that hold the inner support members 42, 44 in adjusted positions relative to the intermediate support members 38, 40, (ii) pivoting the inner support members 42, 44 to adjusted angular positions (the slots 70 in the inner support members and the threaded rods 72 guide such movement) and then (iii) tightening the nuts, to secure the inner support members 42, 44 in adjusted angular positions relative to the intermediate support members.

As can be seen from the foregoing discussion, a relatively small number of components need to be manipulated to adjust the slot coating die head relative to the web 20. In order to angularly adjust the slot coating die head relative to the web, all that is required is loosening of the nuts and adjustment of one or both of the inner support members 42, 44 relative to the intermediate support members. In order to effect fine adjustment of the slot coating die head relative to the web, all that is required is turning the knobs 86 at one or both end of the intermediate support members. Finally, adjustment of the entire assembly is effected by actuation of the double acting air cylinder 100.

Further, according to the present invention, it is contemplated that a spacer sleeve may be provided surrounding a shaft which extends between the outer support members. Such a spacer sleeve would insure against cocking of the outer support members under the action of the double acting air cylinder.

Thus, according to the present invention, a simplified bracket structure for a slot coating die head is provided. With the present invention in mind, it is believed that various modifications of the foregoing structure, in accordance with the principles of this invention, will become apparent to those of ordinary skill in the art.

We claim:

1. Support structure for a slot coating die comprising:

a frame, a plurality of support members connected with said frame, a slot coating die head structure;

said plurality of support members including at least one an inner support member and at least one intermediate support member located between said inner support member and said frame, said intermediate support member connected with said frame and moveable with respect to said frame, said inner support member connected with said intermediate support member and movable with respect to said intermediate support member, said plurality of support members providing compound movement based on movement of said inner support member relative to said intermediate support member and movement of said intermediate support member relative to said frame; said slot coating die head structure being coupled to said inner support member for movement therewith;

an intermediate adjustment mechanism for adjusting the position of said intermediate support member with respect to said frame; and an inner adjustment mechanism for releasably clamping said inner support member in a desired position with respect to said intermediate support member.

2. Support structure as defined in claim 1, wherein said frame comprises a pair of spaced apart side frame members, said plurality of support members further comprising a pair of outer support members, each disposed adjacent a respective side frame member and pivotally supported thereon, said at least one intermediate support member comprising a pair of intermediate support members, each disposed adjacent a respective outer support member and pivotally supported thereon, and said at least one inner support member comprising a pair of inner support members, each disposed adjacent a respective intermediate support member and pivotally supported thereon;

each of said pair of inner support members having a respective support surface, said slot coating die head structure resting on said support surfaces of said pair of inner support members and being coupled to said pair of inner support members for movement therewith, said inner adjustment mechanism releasably clamping each of said inner support members to an adjacent intermediate support member.

3. Support structure as defined in claim 2, wherein said slot coating die head structure comprises a support bar with end portions resting on respective support surfaces of said inner support members; and fasteners for coupling said end portions to said inner support members;

each of said end portions of said support bar including an opening through which a fastener extends, to couple the end portion of said support bar with a respective inner support members, each opening in said support allowing some pivotal movement of the support bar relative to the inner support member, at least one opening in said support bar allowing some relative movement of a fastener along the length of the support bar while allowing pivotal movement of the end portions of the support bar relative to the inner support members, and a respective spring member between each of the fasteners and said support bar, to maintain a bias between each fastener and the support bar as the end portions of the support bar pivot relative to the inner support members.

4. Support structure as defined in claim 2, including means for applying a biasing force between each intermediate support member and a respective outer support member, said intermediate adjustment mechanism acting between each intermediate support member and its respective outer support member to overcome said biasing force to adjust the position of the intermediate support member with respect to the respective outer support member, said means for applying said biasing force including means for locking the position of the intermediate support member to the outer support member after adjustment of said coating die has been accomplished.

5. Support structure as defined in claim 2, wherein said inner adjustment mechanism includes for each of said inner support members an arcuate slot and for each of said intermediate support members an integral pin extending through the arcuate slot in an adjacent inner support member, the arcuate slots in the inner support members and the associated pins in the intermediate support members enabling each inner support member to be pivotally adjusted along a predetermined arcuate path relative to its adjacent intermediate support member.

6. Support structure as defined in claim 5, wherein a cross bar couples with said outer support members together, and a fluid actuator acts on a portion of one of the outer support members to adjust the position of the outer support members relative to said frame.

7. Support structure as defined in claim 1, wherein a drip pan is attached to said inner support member in fixed relationship therewith, said drip pan being oriented relative to said slot coating die head structure to capture drippings from the slot coating die head irrespective of the adjusted position of the slot coating die head.

8. A slot coating die device, comprising:

a frame, a plurality of support members connected with said frame, said plurality of support members including an outer support member connected with said frame which is moveable with respect to said frame, and an inner support member connected with said outer support member which is movable with respect to said outer support member, said plurality of support members providing compound movement based on movement of said inner support member relative to said outer support member and movement of said outer support member relative to said frame;

a slot coating die head structure being coupled to said inner support member for adjustment therewith; and a drip pan disposed gravitationally below an exit slot of the slot coating die head and fixedly attached to said inner support member for movement therewith, whereby material dripping from the slot coating die head is captured by the drip pan irrespective of the adjusted position of the slot coating die head.

9. The slot coating die device of claim 8, wherein said frame comprises a pair of spaced apart side frame members, and said plurality of support members comprises:

(i) a pair of outer support members, each disposed adjacent a respective side frame member and pivotally supported thereon, (ii) a pair of intermediate support members, each disposed adjacent a respective outer support member and pivotally supported thereon, and (iii) a pair of inner support members, each disposed adjacent a respective intermediate support member and pivotally supported thereon; each of said pair of inner support members having a respective support surface, said slot coating die head structure resting on said support surfaces of said pair of inner support members and being coupled to said pair of inner support members for movement therewith.

10. A slot coating die device, comprising:

a frame and a plurality of support members connected with said frame, said frame comprising a pair of spaced apart side frame members, said plurality of support members comprising (i) a pair of outer support members, each disposed adjacent a respective side frame member and pivotally supported thereon for pivotal movement about a first axis, and (ii) a pair of intermediate support members, each disposed adjacent a respective outer support member and pivotally supported thereon for pivotal movement about a second axis spaced apart from said first axis a slot coating die head structure operatively connected with said pair of intermediate support members for movement therewith;

means for applying a biasing force between each intermediate support member and a respective outer support member; and an adjustment mechanism acting between each intermediate support member and a respective outer support member for adjusting the position of the intermediate support member and a respective outer support member by overcoming said biasing force.

11. The slot coating die device of claim 10, wherein said means for applying a biasing force comprises a pair of springs each providing a compressive force for biasing an intermediate support member apart from a respective outer support member, and wherein said adjustment mechanism includes a pair of adjustable screws each of which adjusts the position of an intermediate support member and a respective outer support member by overcoming said compressive force.

12. The slot coating die of claim 10, wherein said means for applying said biasing force includes means for locking the position of the intermediate support members to the outer support members after adjustment of the coating die has been accomplished.

13. The slot coating die of claim 10, wherein said plurality of support members further comprises a pair of inner support members, each disposed adjacent a respective intermediate support member and pivotally supported thereon for pivotal movement about a third axis spaced apart from said first and second axes, and wherein said slot coating die head structure is coupled to said pair of inner support members for movement therewith.

14. The slot coating die of claim 13, wherein said slot coating die head structure includes a die opening which extends substantially between said inner support members generally in co-linear alignment with said third axis.

15. The slot coating die of claim 10, further comprising a cylinder for effecting said pivotal movement of said outer support members about said first axis.

16. The slot coating die of claim 15, further comprising an adjustable stop member for limiting a range of said pivotal movement of said outer support members about said first axis.

* * * * *